US005409220A

United States Patent [19]

Lombardo

[11] Patent Number: 5,409,220

[45] Date of Patent: Apr. 25, 1995

[54] PUTTER WITH ADVANTAGEOUSLY ANGLED AND CONSTRUCTED SHAFT

[76] Inventor: John B. Lombardo, 61 Perrine St., Auburn, N.Y. 13021

[21] Appl. No.: 238,937

[22] Filed: May 6, 1994

[51] Int. Cl.[6] ..... A63B 53/00

[52] U.S. Cl. ..... 273/80 B; 273/80 C; 273/167 G

[58] Field of Search ..... 273/167 G, 80 C, 80 A, 273/81 A, 80 R, 77 R, 164.1, 170, DIG. 3, 80 B

[56] References Cited

U.S. PATENT DOCUMENTS

| | | | |
|---|---|---|---|
| 1,631,926 | 6/1927 | Dickinson, Jr. . | |
| 1,894,841 | 1/1933 | Adams | 273/170 |
| 1,904,750 | 4/1933 | Reach . | |
| 1,950,342 | 3/1934 | Meshel | 273/80 R |
| 2,820,638 | 1/1958 | Morrison | 273/80 C |
| 3,081,087 | 3/1963 | Redd | 273/80 C |
| 3,083,969 | 4/1963 | Bills | 273/80 R |
| 3,497,220 | 2/1970 | Scott | 273/80 C |
| 3,762,707 | 10/1973 | Santorelli | 273/80 B |
| 3,833,223 | 9/1974 | Shulkin | 273/80 B |
| 4,063,733 | 12/1977 | Benedict | 273/80 C |
| 4,240,636 | 12/1980 | Swenson . | |
| 4,253,667 | 3/1981 | Clark | 273/167 G |
| 4,523,758 | 6/1985 | Guendling, Jr. . | |
| 4,580,785 | 4/1986 | Toku | 273/80 B |
| 4,795,153 | 1/1989 | Thomas . | |
| 4,832,340 | 5/1989 | Pickering | 273/80 C |
| 4,966,369 | 10/1990 | Griffin . | |
| 5,080,363 | 1/1992 | Soong . | |
| 5,172,915 | 12/1992 | Flis . | |
| 5,226,654 | 7/1993 | Solheim . | |
| 5,253,868 | 10/1993 | Baumann et al. . | |
| 5,257,807 | 11/1993 | Baumann et al. . | |
| 5,262,118 | 11/1993 | Fukushima et al. . | |

FOREIGN PATENT DOCUMENTS 2217611 11/1989 United Kingdom .

OTHER PUBLICATIONS

1993 Rules of Golf, ©1992, USGA, pp. 1 and 105–110.

*Primary Examiner*—Sebastiano Passaniti
*Attorney, Agent, or Firm*—Nixon & Vanderhye

[57] ABSTRACT

A putter includes a putter head and a putter shaft with a first end connected to the head and a second end forming a handle for gripping by a golfer. The shaft is connected to the putter head and disposed with respect to the putter head so as to allow a golfer using the putter to address a golf ball with the putter in substantially the same manner as he or she would when using an iron or wood. The shaft includes a first straight portion, a bend, and a second straight portion extending from the bend to the second end of the shaft. The first portion preferably has a lie angle of about 70°–80° and the second portion has a lie angle of about 50°–70°. A weight is formed as part of the shaft, or disposed within the hollow interior of a metal tube forming the shaft, at the first portion of the shaft and part of the second portion, so that the moment of the putter and first portion of the shaft about the bend is substantially the same as the moment of the second portion of the shaft (with attached grip) about the bend.

20 Claims, 4 Drawing Sheets

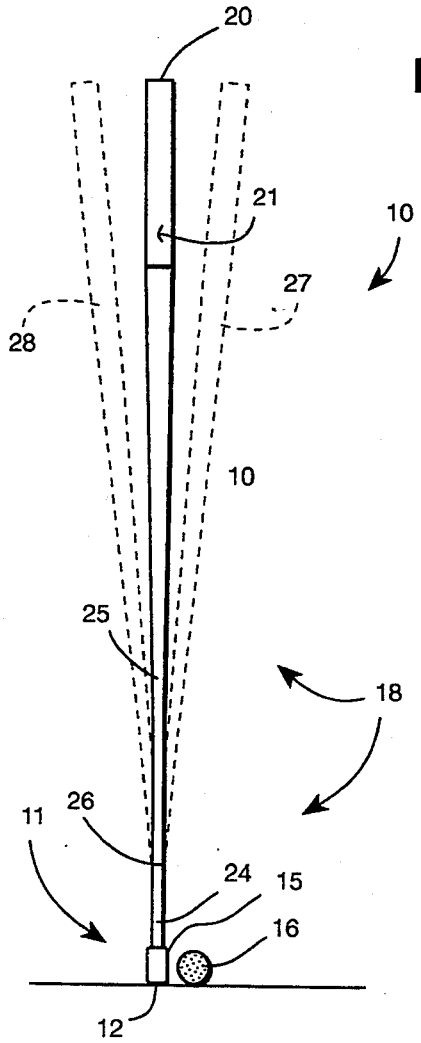
Fig. 2
Fig. 4
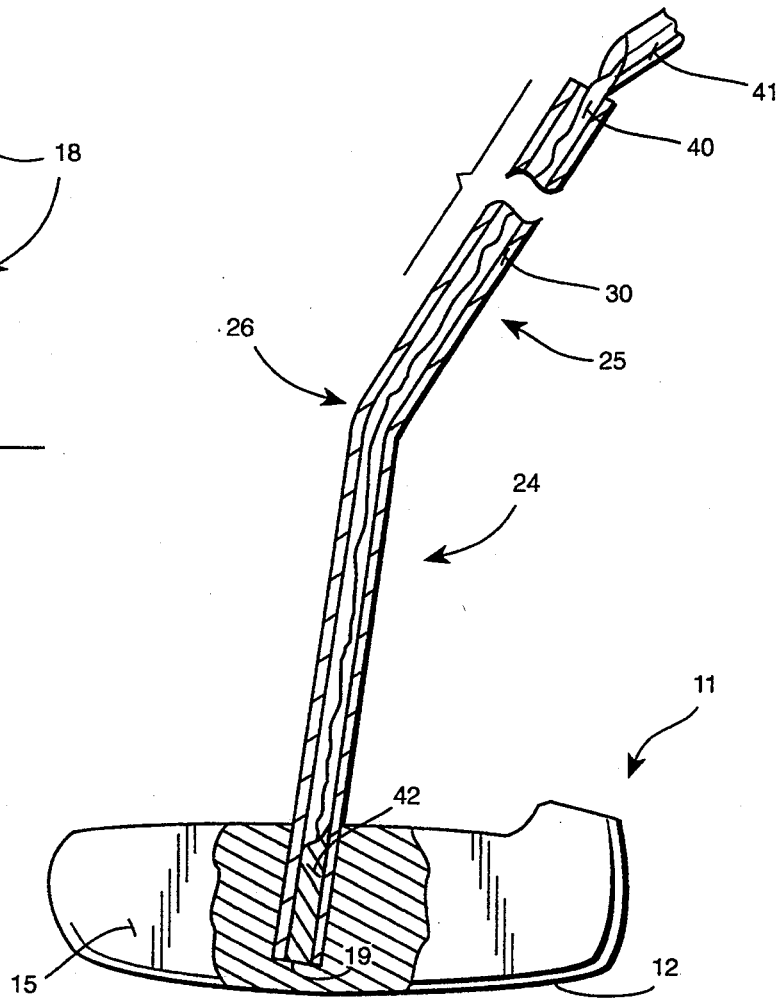

PUTTER WITH ADVANTAGEOUSLY ANGLED AND CONSTRUCTED SHAFT

BACKGROUND AND SUMMARY OF THE INVENTION

The obvious use of a putter by a goiter is to get the ball into the hole in the fewest number of strokes. For each stroke the main objective is to start the ball on the correct line to the hole, and to judge the speed of the ball so that it will have enough inertia to travel the correct distance to the hole. The putter according to the present invention is specifically designed so as to minimize the number of putts that a goiter must use, and has the potential to increase putting efficiency for most golfers.

One of the keys to successful golfing is to develop a consistent "golf swing" so that a ball may be impacted with essentially the same motion of the golfer's body for each situation. This is clearly demonstrated by the fact that a wide variety of different types of irons and woods are utilized by golfers which have the ability to impart different distances and flight trajectories to the ball when moving from tee to green. In developing a consistent golf swing the eye line is to one side of the intended line of flight toward the target, and the club is swung on a rotational basis around the body. Experienced golfers are used to swinging in one manner, and to seeing the same line of sight for each swing.

Despite the general desire to use essentially the same motion when striking a ball with all clubs, once the golfer uses a putter the techniques and line of sight change dramatically. In traditional putting the eyes are placed over the ball and on the intended line of sight toward the hole. Thus traditional techniques (such as shown in U.S. Pat. 4,240,636) require the golfer to place his or her eyes over the ball, manipulate his/her hands, arms, shoulders and head in a manner which is unnatural to the previously learned and practiced full golf swing, and in general to learn a whole new "swing" that is unique to putting.

According to the present invention a putter is provided that allows the golfer to address the ball in the same manner as he or she would in a full swing, and see the same line of sight in the same manner as if using an iron or wood. Thus the putter according to the present invention allows a golfer's physical set up to be comfortable and "normal" for the tee to green approach, allowing the player to concentrate on the act of stroking the ball and not how she or he is going to have to set up. The golfer can better judge distance due to the final balance of the putter according to the present invention and the more familiar line of sight, ultimately allowing the ball when impacted to roll consistently on its intended line, a high moment of inertia being provided.

The putter according to the present invention utilizes two basic structures to achieve the desired result either one having some advantages alone, but in combination being extremely advantageous. The first feature of the invention is to provide a particularly angled shaft of the putter which facilitates the proper line of sight when addressing the golf ball. The second feature of the invention is the provision of a weight associated primarily with the lower part of the shaft to provide the type of balance that is necessary to ensure proper striking of the ball with the "sweet spot" of the putter.

According to one aspect of the present invention a putter is provided comprising the following elements: A putter head including a sole that is substantially flat and substantially in a common plane, a center, and a substantially flat face surface defining a plane substantially perpendicular to the sole, and for striking a golf ball. A putter shaft having first and second ends, the first end connected to the putter head at or adjacent the putter head center, the second end forming a handle for gripping by a golfer, the shaft having a first straight portion at and adjacent the first end, a second portion and a bend between the first and second portions so that they make an angle of significantly less than 180 degrees with respect to each other. The second portion being straight from the bend to the second end. The bend is not more than about five inches from the putter head (e.g. between about 4.5–5.0 inches from the putter head, preferably about 4.75 inches); and, the first portion has a lie angle of between about 70–80 degrees, and the second portion having a lie angle of between about 50–70 degrees.

The shaft and head may be essentially in a common plane. Alternatively where a golfer is skilled in the use of the putter according to the invention, there can be further manipulations of the bend of the shaft so as to create an "on set" where the face of the putter head is in front of the bend, or an "off set" where the face is behind the bend in the shaft (e.g. the shaft past the bend from the putter head making an angle of about 1°–5° with respect to the striking ace).

The second shaft portion preferably has a grip thereon at and adjacent the second end of the shaft, and the putter further comprises a weight associated with substantially the entire length of the first shaft portion and with at least a part of the second shaft portion so that the moment of the head and first shaft portion about the bend is substantially equal to the moment of the second shaft portion about the bend. The weight can be provided in a number of different manners depending upon the construction of the shaft.

The shaft may comprise a metal tube that is substantially hollow from the first to the second ends thereof. The weight may comprise a material extending from the putter head throughout the length of the first shaft portion and in the second shaft portion from the bend partway toward the shaft second end (e.g. about 7–14 inches from the bend). The material then may comprise a metal (e.g. steel) rod stable within the metal tube so that there is no rattling of the rod in the tube. Alternatively the material may comprise a molten material (such as lead, or epoxy or another resin) that has been introduced into the metal tube and has hardened therein and which again is stable within the metal tube. Such material should have a relatively high density and a relatively low melting point so that it will not damage the metal tube and so that a relatively small amount need be used to provide the necessary "balance".

Alternatively the appropriate weight balance may be obtained by constructing the shaft first portion and bend of a solid metal (e.g. steel) rod anchored in the putter head. In this case the shaft second portion past the bend comprises a hollow metal tube connected to and surrounding the solid metal rod.

According to another aspect of the present invention a putter is provided comprising the following elements: A putter head including a sole that is substantially flat and substantially in a common plane, a center, and a substantially flat face substantially perpendicular to the sole, and a striking surface defining a plane for striking a golf ball. A putter shaft having first and second ends, the first end connected to the putter head at or adjacent the putter head center, and the second end forming a handle for gripping by a golfer, and the shaft having a first straight portion at and adjacent the first end, a second portion, and a bend between the first and second portions so that they make an angle of significantly less than 180 degrees with respect to each other. The second portion being straight from tile bend to tile second end. The second shaft portion having a grip thereon at and adjacent the second end of the shaft; and, a weight associated with at least a part of the second shaft portion so that the moment of the head and first shaft portion about the bend is substantially equal to the moment of the second shaft portion about the bend. The particular manner in which the weight is provided is as described earlier, or in a like manner.

According to yet another aspect of the invention a putter is provided comprising the following elements: A putter head including a sole that is substantially flat and substantially in a common plane, a center, and a substantially flat face surface substantially perpendicular to the sole, and defining a plane for striking a golf ball. A putter shaft having first and second ends, the first end connected to the putter head, and the second end forming a handle for gripping by a golfer. And, the shaft being connected to the putter head and disposed with respect to the putter head so as to allow a golfer using the putter to address a golf ball with the putter in the same manner as he or she would when using an iron or wood.

It is the primary object of the present invention to provide a unique and advantageous putter. This and other objects of the invention will become clear from an inspection of the detailed description of the invention and from the appended claims.

BRIEF DESCRIPTION OF THE DRAWINGS

FIG. 2 is a front end view of the putter of FIG. 1, and showing in dotted line two other alternative configurations thereof;

FIG. 4 is a view like that of FIG. 3 only showing yet another embodiment of putter according to the present invention.

DETAILED DESCRIPTION OF THE DRAWINGS

Figure 1:
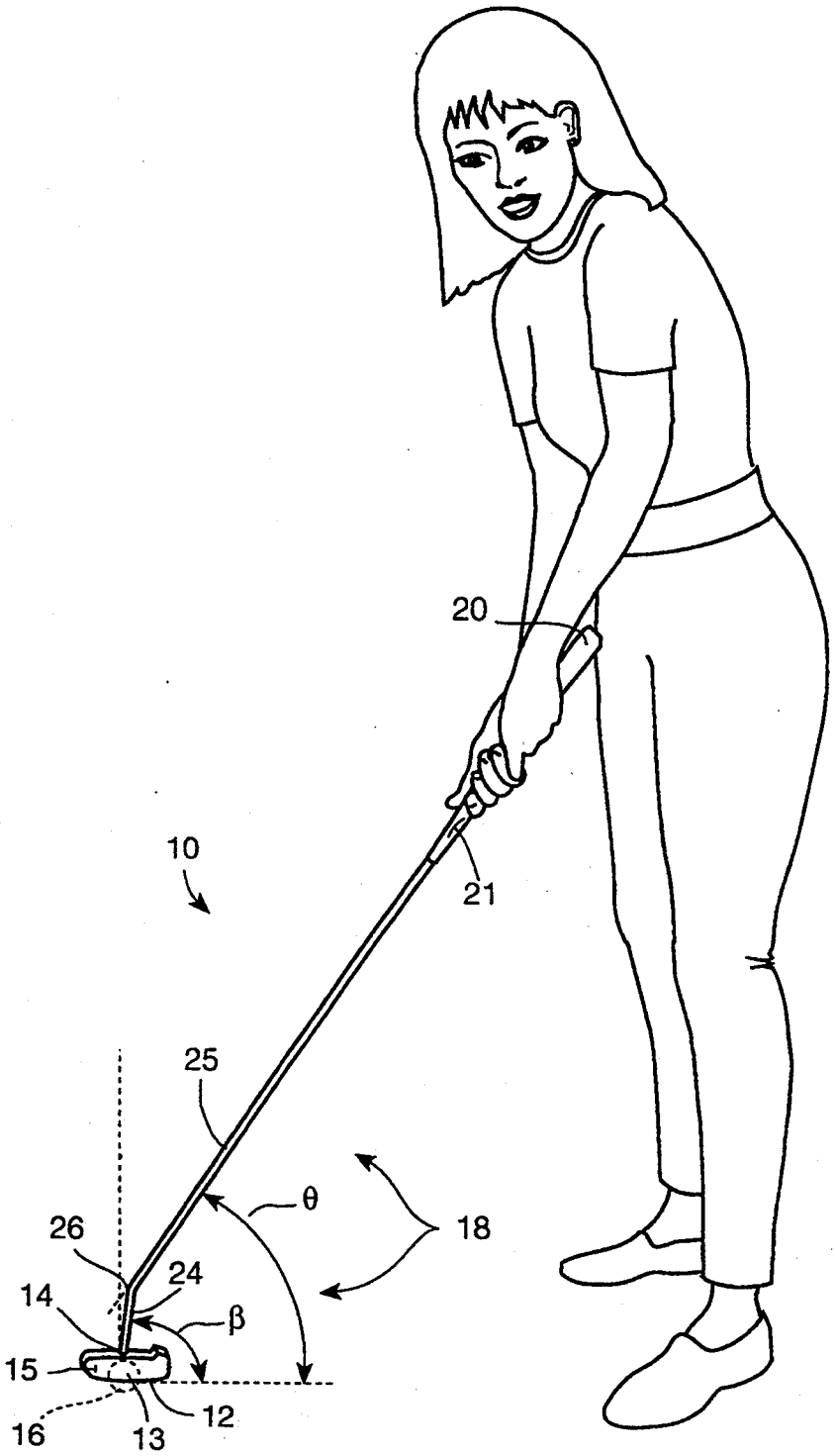
FIG 1 is a side elevational view illustrating an exemplary putter according to the present invention being used by a golfer to putt a golf ball.
Figure 3:
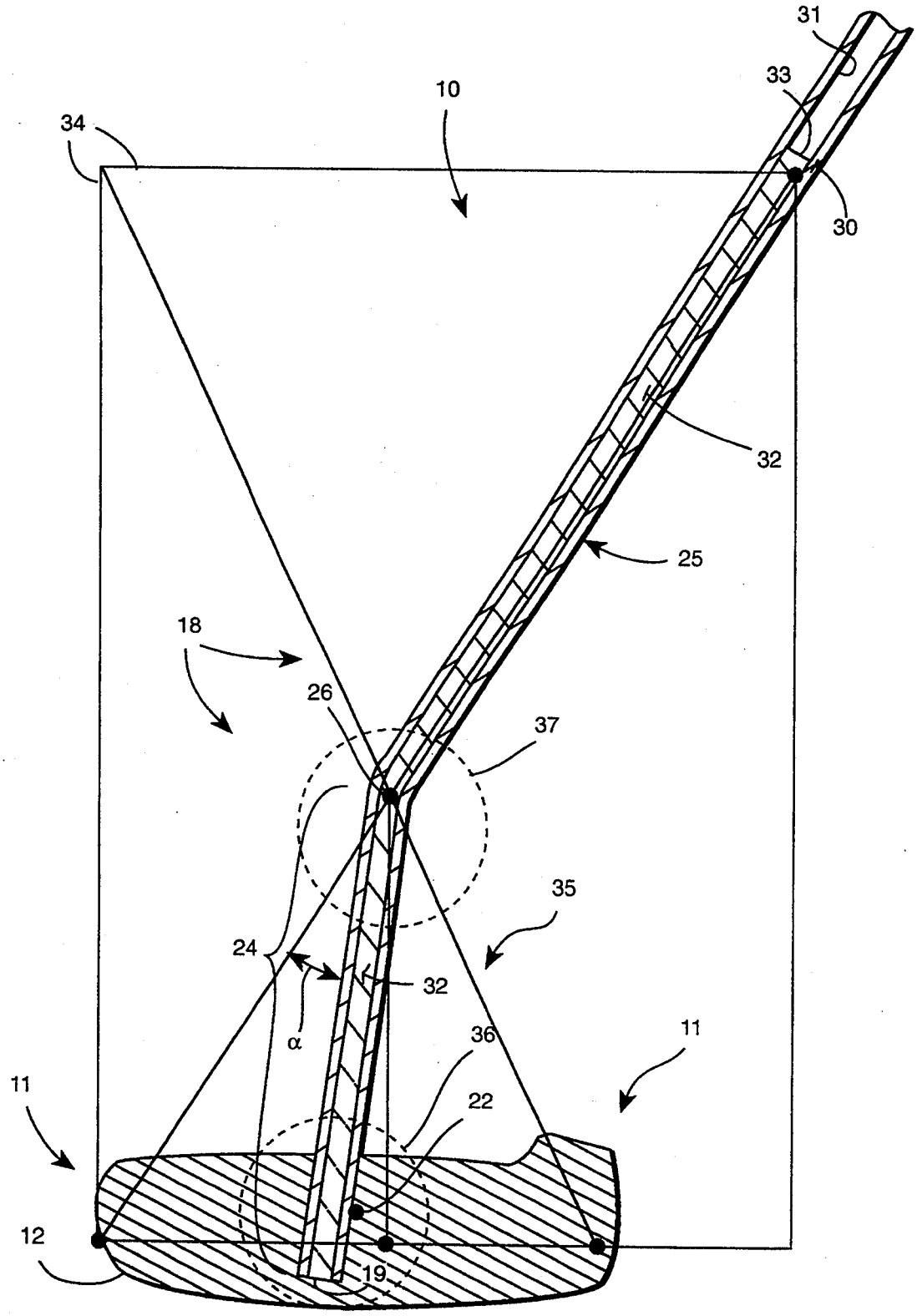
FIG. 3 is a detail view, partly in cross-section and partly in elevation, of the putter of FIGS. 1 and 2 and showing various geometrical relationships associated therewith.

An exemplary putter according to the present invention is shown generally by reference numeral 10 in FIGS. 1 through 3. Of course an essential characteristic of the putter is that it have a putter head. The putter head of the putter 10 is shown generally by reference numeral 11 in all of the drawing figures, and is of any desired conventional construction. The putter head 11 includes a sole 12 that is substantially flat and substantially in a common plane (although many putter heads have a small curvature about the center 13 thereof which is within the definition of "substantially fiat" and "substantially in a common plane"). The head 11 also has a center line, indicated at 14 in FIG. 1, and a substantially flat face 15 defining a plane substantially perpendicular to the sole 12, and for striking a golf ball 16.

The putter 10 according to the present invention has a shaft —shown generally by reference numeral 18 in FIGS. 1 through 3—that is configured, and connected to the head 11, in such a manner so as to achieve the advantageous results desired for the invention. In essence the shaft 18 is connected to the putter head 11 and disposed with respect to the head 11 so as to allow a goiter using the putter 10 to address a golf ball 16 with the putter 10 in substantially the same manner as he or she would when using an iron or wood. A golfer's line of sight using the putter 10 is then substantially the same as for using a wood or an iron, and thus the putter 10 allows the golfer to concentrate on the act of stroking the ball, not how he or sloe is going to set up, and allows the ball to be struck in such a way that it rolls consistently on its intended line to the target (hole).

The putter shaft 18 has a first end 19 (see FIG. 3) and a second end 20. As seen in FIGS. 1 and 2—as would be the most practical construction—the second end 20 is covered by a conventional putter grip 21.

The first end 19 is connected to the putter head 11 at or near the center of the putter head 11, which is shown schematically as the center of gravity point 22 in FIG. 3, and which is typically on or only slightly spaced from the center vertical line 14. The second end 20—as earlier described—forms a handle for gripping by the golfer, using a grip 21.

The shaft 18 has a first straight portion 24 and adjacent the first end 19, a second portion 25, and a bend 26 between first and second portions 24, 25 so that they make an angle of significantly less than 180° with respect to each other (e.g. the complement of the angle $\alpha$ in FIG. 3, which angle $\alpha$ typically is about 5°–35°). The second portion 25 is straight from the bend 26 to the second end 20, and bend 26 is not more than about five inches from the sole 12 of the putter head 11 (if the club 10 is to be constructed according USGA rules; see Appendix II, Section 4-lb, last paragraph). Preferably the. bend 26 is about 4½ inches from the putter head 11 (e.g. between about 4.5 and 5.0 inches).

With the construction as described above and illustrated in FIGS. 1 through 3, the first portion 24 typically has a lie angle $\beta$ (see FIG. 1) of between about 70° and 80°. The term "lie angle" traditionally is defined as the angle made between the shaft and the sole of the club head. An angle $\beta$ of about 79° is desirable.

The lie angle $\Theta$ (see FIG. 1) of the second portion 25 is between about 50°–70°. The optimum lie angle $\Theta$ may vary according to the height and build of the golfer and his or her preferences, but will typically be substantially the same if not identical to the lie angle for the golfer's other clubs (woods and irons), e.g. about 60°.

Utilizing the putter 10 as described above, enables the golfer to "slide" or "settle" into his or her natural swing orientation without any of the artificiality created by traditional putting methods. Once the golfer finds the putter that fits his or her swing by trial and error (based upon a starting position that corresponds to the lie angle of most of the golfer's clubs) when she or he addresses the ball in her's or his natural posture, and the sole 12 is flat, the golfer has found the proper putter 10 with the proper lie angle $\Theta$.

Under some circumstances for individual golfers it may be desirable to have the face 15 slightly in front of the bend 26, or slightly behind the bend 26, the first orientation being called "on set" and the second "off set". These constructions are illustrated in dotted line in FIG. 2, an "on set" orientation being illustrated schematically at 28 in FIG. 2, and an "off set" orientation being illustrated schematically at 27. The angle that the orientations 27, 28 make from either side of "vertical" (the solid line configuration in FIG. 2, which is typically essentially co-planar with the striking face 15) is between about 1°-5°.

Not only is the lie angle of the putter 10 according to the present invention important, also important is the proper balance of the putter 10. Proper balance allows the putter to deliver the striking face 15 to the ball 16 in a consistent manner, also contributing to the effect of rolling the ball 16 consistently on its intended line to the target (hole), and to provide a high moment of inertia. Proper balance is facilitated according to the present invention by providing a weight associated with the shaft 18 first end 24 and part of the second end 25. With respect to FIG. 3, the moment (force times distance from the bend 26) is provided so that the portion of the club 10 below the bend 26 therein (that is the club head 11 and the first portion 24 of the shaft 18) is substantially equal to the moment of portion of the putter 10 above the bend 26 (the second shaft portion 25 and the grip 21).

In the embodiment illustrated in FIG. 3, the shaft 18 comprises a hollow metal tube having a metal tube wall 30, and a hollow interior 31 substantially along the entire length thereof (from end 19 to end 20). The end 19 is anchored in the head 11, as by a press fit, welding, or other conventional secure attachment technique, and the weight is provided by a solid rod 32. The rod 32 is typically of a dense material—for example a steel solid rod 32 is preferred. It typically extends from the end 19, within the head 11, to the bend 26, and then from the bend 26 partway through the shaft second end 25, but in the vast majority of the situations not all the way to the end 20. For most common constructions the rod 32 would extend from the bend 26 up into the second portion 25 about 7-14 inches. Of course this would depend upon the weight and exact position of the head 11, the density and wall 30 thickness of the metal tube forming the shaft 18, if there was any weight in the shaft end 20, and other variables.

As illustrated in FIG. 3, the construction of the putter 10 according to the invention sets up an appropriate spatial balance rectangle 34 and an appropriate balance triangle 35. The spatial balance rectangle includes the area from the toe of the putter head 11 through the remote (from the head 11) end 33 of the rod 32 and will be smaller or larger depending upon the weight and size of the head 11, etc. The balance triangle 35, which comprises essentially an equi-lateral triangle with a base comprising a straight line between the toe and heel of the head 11 and the apex at the bend 26, provides a three-way weighting system; combined with the spatial balance rectangle 34 geometry essentially a five-way balance weighting system is provided with a dual sweet spot. Sweet spots are shown generally by circles in FIG. 3, the first sweet spot 36 is provided in the head 11 and the second sweet spot 37 is provided in the shaft bend 26 itself.

There are a number of different ways that the proper weighting can be provided to "balance" the putter 10. Another way that this can be done is illustrated in FIG. 4 is similar to the FIG. 3 construction except that instead of a solid metal rod 32 being initially provided in the metal tube 30 and bent into place, or the rod 32 being segmented at the bend 26 so that one portion is introduced from the end 19 and the other portion introduced from the end 20, a molten material may be poured into the tube 30 and allowed to harden in place. FIG. 4 schematically illustrates molten material 40 being poured or otherwise introduced into the hollow tube 30 (in this case being poured from a pour spout 41 of a pouring vessel (not shown)) and filling up the tube 30 as indicated by the portion 42 that has already formed a level in the tube 30 in FIG. 4. The material 40 has a melting point significantly lower than that of the metal (e.g. steel) tube 30, and also preferably is a dense material, typically having a density of at least about ⅔ that of the metal tube 30, and preferably at least about the same density as the tube 30. The material 40 may, for example, be a molten metal such as lead, or may be an epoxy or other resin.

In both the FIGS. 3 and 4 embodiments it is important that the material filling the hollow tube 30 be stable in the tube 30 so that there is no "rattling". Thus it is important to have the tube 30 at the appropriate temperature during pouring in the FIG. 4 embodiment, and to select the material so that its coefficient of thermal expansion or contraction is not too dissimilar from that of the tube 30, to provide stability. Also it may be necessary to pour or jam in a sealing material or block (e.g. a rubber plug) into the shaft section 25 from the end 20 so as to prevent movement of the rod 32.

Figure 5:
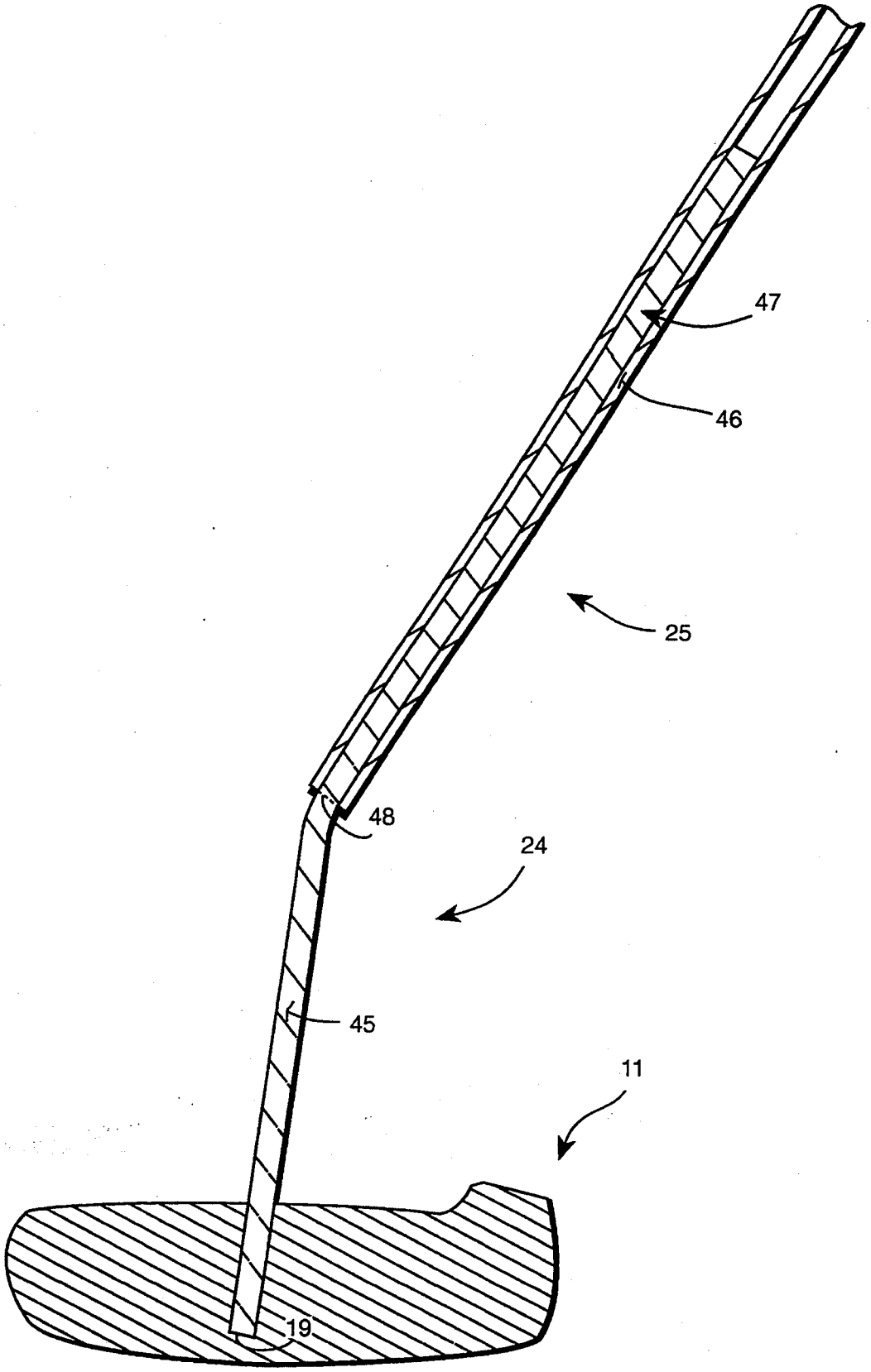
FIG. 5 is a view like that of FIGS. 3 and 4 only showing yet another embodiment of a putter according to the present invention during a manufacturing stage thereof.

According to another embodiment of the invention—as seen in FIG. 5—the appropriate weight for balance is provided by constructing the shaft 18 so that it comprises a solid rod 45 as the first section 24 of the shaft 18, and the bend 26. The second portion 25 of the shaft 18 may then comprise a hollow metal tube 46 which surrounds that portion of the rod 45 that is past the bend 26 from the head II (that is the portion illustrated schematically at 47 in FIG. 5) and is affixed thereto. Affixing thereto can be accomplished at least in part by providing a seal (e.g. by welding or other appropriate conventional technique) 48 at the bottom of the tube 46 just above the bend 26, and by crimping the tube 46 into contact with the solid metal (e.g. steel) rod portion 47 between the bend 26 and the second end 20 of the putter 10.

Under some circumstances it may be possible to provide the weight so that it is only associated with the second portion 25 of the shaft 18, or the second portion 25 and the bend 26, of course depending upon the magnitude of the weight, the configuration of the head 11, the lie angle Θ, and other factors.

It will thus be seen that according to the present invention an advantageous putter is provided. After sufficient practice the putter according to the present invention will allow many golfers to improve their putting game since they can concentrate on the act of striking the ball not on how they should address the ball, they can better judge distance, and as a result of the balance, design and construction of the putter can effect rolling of the ball consistently on its intended line.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A putter comprising:

a putter head including a sole that is substantially flat and substantially in a common plane, a center, and a substantially flat face surface defining a plane substantially perpendicular to said sole, and for striking a golf ball;

a putter shaft having first and second ends, said first end connected to said putter head at or adjacent said putter head center, said second end forming a handle for gripping by a golfer, said shaft having a first straight portion at and adjacent said first end, a second portion, and a bend between said first and second portions so that they make an angle of significantly less than 180 degrees with respect to each other;

said second portion being straight from said bend to said second end;

said bend being not more than about five inches from said sole of said putter head; and said first portion having a lie angle of between about 70–80 degrees, and said second portion having a lie angle of between about 50–70 degrees.

2. A putter as recited in claim 1 wherein said shaft and head are essentially in a common plane.

3. A putter as recited in claim 1 wherein said putter shaft first and second portions are constructed to allow a golfer using the putter to address a golf ball with the putter in substantially the same manner as he or she would when using an iron or wood, having substantially the same line of sight.

4. A putter as recited in claim 3 wherein said second shaft portion has a grip thereon at and adjacent said second end of said shaft; and wherein said putter further comprises a weight associated with substantially the entire length of said first shaft portion and with at least a part of said second shaft portion so that the moment of said head and first shaft portion about said bend is substantially equal to the moment of said second shaft portion about said bend.

5. A putter as recited in claim 4 wherein said shaft comprises a metal tube that is substantially hollow from said first to said second end thereof, and wherein said weight comprises a material extending from said putter head throughout the length of said first shaft portion, and in said second shaft portion from said bend partway toward said shaft second end.

6. A putter as recited in claim 5 wherein said material comprises a metal rod stable within said metal tube so that there is no rattling of said rod in said metal tube.

7. A putter as recited in claim 5 wherein said material comprises a molten material that has been introduced into said metal tube and has hardened therein and is stable within said metal tube so that there is no rattling of said material in said metal tube.

8. A putter as recited in claim 7 wherein said material is a metal that has a lower melting point than said metal tube and has a density at least about equal to that of said metal tube, or an epoxy or other resin having a lower melting point than said metal tube and a density at least about $\frac{2}{3}$ that of said metal tube.

9. A putter as recited in claim 4 wherein said shaft first portion and bend comprises a solid metal rod anchored in said putter head, and wherein said shaft second portion past said bend comprises a hollow metal tube connected to and surrounding said solid metal rod.

10. A putter as recited in claim 9 wherein said solid metal rod has a length of between about 7–14 inches from said bend toward said shaft second end.

11. A putter as recited in claim 4 wherein said bend is between about 4.5–5.0 inches from said putter head.

12. A putter as recited in claim 1 wherein said shaft between said head and said second end is substantially disposed in a common plane; and wherein said common plane makes an angle of between about 1 and 5 degrees with respect to said head striking face.

13. A putter as recited in claim 1 wherein said second shaft portion has a grip thereon at and adjacent said second end of said shaft; and wherein said putter further comprises a weight associated with substantially the entire length of said first shaft portion and with at least a part of said second shaft portion so that the moment of said head and first shaft portion about said bend is substantially equal to the moment of said second shaft portion about said bend.

14. A putter comprising:

a putter head including a sole that is substantially fiat and substantially in a common plane, a center, and a substantially flat face substantially perpendicular to said sole, and a striking surface defining a plane for striking a golf ball;

a putter shaft having first and second ends, said first end connected to said putter head at or adjacent said putter head center, and said second end forming a handle for gripping by a golfer, and said shaft having a first straight portion at and adjacent said first end, a second portion, and a bend between said first and second portions so that said first and second portions make an angle of significantly less than 180 degrees with respect to each other;

said second portion being straight from said bend to said second end;

said second shaft portion having a grip thereon at and adjacent said second end of said shaft; and a weight associated with at least a part of said second shaft portion so that the moment of said head and first shaft portion about said bend is substantially equal to the moment of said second shaft portion about said bend.

15. A putter as recited in claim 14 wherein said shaft comprises a metal tube that is substantially hollow from said first to said second end thereof, and wherein said weight comprises a material extending from said putter head throughout the length of said first shaft portion, and in said second shaft portion from said bend partway toward said shaft second end.

16. A putter as recited in claim 15 wherein said material comprises a metal rod stable within said metal tube so that there is no rattling of said rod in said metal tube.

17. A putter as recited in claim 15 wherein said material comprises a molten material that has been introduced into said metal tube and has hardened therein and is stable within said metal tube so that there is no rattling of said material in said metal tube.

18. A putter as recited in claim 17 wherein said material is a metal that has a lower melting point than said metal tube and has a density at least about equal to that of said metal tube.

19. A putter as recited in claim 14 wherein said shaft first portion and bend comprises a solid metal rod anchored in said putter head, and wherein said shaft second portion past said bend comprises a hollow metal tube connected to and surrounding said solid metal rod.

20. A putter as recited in claim 17 wherein said material is an epoxy or other resin having a lower melting point than said metal tube and a density at least about $\frac{2}{3}$ that of said metal tube.

* * * * *